United States Patent [19]

Trosky et al.

[11] 4,418,795

[45] Dec. 6, 1983

[54] ELEVATOR SERVICING METHODS AND APPARATUS

[75] Inventors: William J. Trosky, Pittsburgh; Kenneth M. Eichler, N. Versailles; Alan F. Mandel, Scott Township, Allegheny County, all of Pa.; William H. Moore, Bridgewater, N.J.

[73] Assignee: Westinghouse Electric Corp., Pittsburgh, Pa.

[21] Appl. No.: 284,843

[22] Filed: Jul. 20, 1981

[51] Int. Cl.[3] ..... B66B 3/00

[52] U.S. Cl. ..... 187/29 R; 364/436

[58] Field of Search ..... 187/29; 364/436

[56] References Cited

U.S. PATENT DOCUMENTS

| | | | |
|---|---|---|---|
| 4,106,593 | 8/1978 | Otto et al. | 187/29 |
| 4,330,838 | 5/1982 | Yoneda et al. | 187/29 X |
| 4,370,717 | 1/1983 | Hummert et al. | 187/29 X |

*Primary Examiner*—J. V. Truhe
*Assistant Examiner*—W. E. Duncanson, Jr
*Attorney, Agent, or Firm*—D. R. Lackey

[57] ABSTRACT

Elevator servicing methods and apparatus which detect and store information relative to user-defined intermittent conditions, or other abnormal operating conditions. The stored information is reproduced for evaluation and analysis in a manner selected by the user, such as on a video monitor and/or a printer.

28 Claims, 10 Drawing Figures

68

INTERMITTENT DEFINITION 1

CAR A

CABLE 1

THRESHOLD TIME = 0

| INPUT | NAME | TRIGGER | MODE |
|---|---|---|---|
| I | | | |
| 2 | | | |
| 3 | | | |
| 4 | | | |
| 5 | | | |
| 6 | | | |
| 7 | | | |
| 8 | | | |
| 9 | ROOF EXIT | | |
| 10 | SIDE EXIT | | |
| 11 | EMERG. STOP SW. | | |
| 12 | UP O.T. | | |
| 13 | DOWN O.T. | | |
| 14 | BUFFER | | |
| 15 | GOVERNOR | | |
| 16 | 29R | X | LOW |

FIG. 4

68

INTERMITTENT DEFINITION 2

CAR A

CABLE 3

THRESHOLD TIME = 0

| INPUT | NAME | TRIGGER | MODE |
|---|---|---|---|
| I | | | |
| 2 | | | |
| 3 | | | |
| 4 | 40R | X | LOW |
| 5 | 41R | | |
| 6 | 65R | X | HIGH |
| 7 | 72T | | |
| 8 | | | |
| 9 | | | |
| 10 | | | |
| 11 | | | |
| 12 | AVP0 | | |
| 13 | AVP1 | | |
| 14 | AVP2 | | |
| 15 | AVP3 | | |
| 16 | AVP4 | | |

FIG. 5

68

INTERMITTENT DEFINITION 3

SYSTEM

CABLE 2

THRESHOLD TIME = 4 SEC.

| INPUT | NAME | TRIGGER | MODE |
|---|---|---|---|
| I | | | |
| 2 | | | |
| 3 | | | |
| 4 | | | |
| 5 | | | |
| 6 | | | |
| 7 | | | |
| 8 | | | |
| 9 | | | |
| 10 | | | |
| 11 | | | |
| 12 | | | |
| 13 | | | |
| 14 | MAN | X | HIGH |
| 15 | MD | X | HIGH |
| 16 | | | |

FIG. 6

68

INTERMITTENT DEFINITION 2

XYZ BUILDING - BANK A - CAR A
APRIL 20, 1981

THRESHOLD TIME = 0

| INPUT | NAME | TRIGGER | MODE |
|---|---|---|---|
| 1 | | | |
| 2 | | | |
| 3 | | | |
| 4 | | | |
| 5 | 40R | X | LOW |
| 6 | 41R | | |
| 7 | 65R | X | HIGH |
| 8 | 72T | | |
| 9 | | | |
| 10 | | | |
| 11 | | | |
| 12 | AVP0 | | |
| 13 | AVP1 | | |
| 14 | AVP2 | | |
| 15 | AVP3 | | |
| 16 | AVP4 | | |

TOTAL NUMBER OF OCCURRENCES ---→ 2

THE MOST RECENT 2 OCCURRENCES WERE AT:

12:48:47 AM (250 MSEC)

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| - | - | - | - | 0 | 0 | 1 | 0 | - | - | - | 0 | 0 | 0 | 0 | 1 |

4:54:59 PM (253 MSEC)

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| - | - | - | - | 0 | 0 | 1 | 0 | - | - | - | 1 | 0 | 0 | 1 | 1 |

FIG. 9

ELEVATOR SERVICING METHODS AND APPARATUS

BACKGROUND OF THE INVENTION

1. Field of the Invention

The invention relates in general to servicing methods and apparatus, and more specifically to such methods and apparatus for servicing elevator systems.

2. Description of the Prior Art

The control for elevator systems is complex due to the large number of different functions which are controlled, and due to the many different interrelationships between the functions. Each elevator car includes a car controller which includes all necessary control for operating the associated elevator car. A hall call controller receives the floor or hall calls which are registered for elevator service, and this controller resets the calls when they have been serviced. When several elevator cars serve the same floors, a group supervisory controller is usually provided which overrides the per car call-answering strategy built into each car controller, and it causes the elevator cars to answer hall calls according to a predetermined operating strategy designed to more efficiently serve the associated building. A malfunction occurring in one of the controllers may be associated with an elevator car, or it may be a system malfunction which affects all elevator cars.

A malfunction which affects safety usually shuts down immediately the associated car, or cars, and they remain out of service until authorized personnel can determine the cause, correct it, and place the car, or cars, back in service. When the safety relay associated with an elevator car drops to take its associated elevator car out of service, for example, it can be due to any one of a large number of different conditions, all of which have a contact in a serial string of contacts which are connected to the safety relay. Thus, many different functions may have to be checked in order for service personnel to determine the exact cause of the malfunction.

Some malfunctions occur intermittently, and the cause may not be apparent at the time service personnel attempt to determine the cause of a particular malfunction. This is true whether the malfunction causes a car to be taken out of service, or whether the malfunction merely causes a degradation of service while the malfunction persists.

Some malfunctions may not be due to any specific combination of detectable events, because the malfunction may be due to a normal combination which persists for an abnormally short, or an abnormally long, period of time.

Some malfunctions may not be easily detectable by the users of the elevator, or by the building owner, and yet the malfunction may be degrading building service because certain operating strategies are not being properly triggered, for example, in response to building operating conditions.

When it is known that service is being degraded due to an intermittent condition, or other abnormal operating condition which is difficult to isolate, the usual approach is for service personnel to bring a multi-channel strip chart recorder into the building. The various channels of the recorder are connected to suspected control elements. A bulky relay timer system may additionally be brought into the building, and connected to the hall call relay contacts. After a significant period of time, the service personnel report back to the building and sort through the reams of paper processed by the recorder, in the hope of detecting the specific cause of the intermittent or abnormal operating condition.

SUMMARY OF THE INVENTION

Briefly, the present invention relates to new and improved servicing methods and apparatus for monitoring for predetermined intermittent conditions, or other abnormal conditions, in an elevator system. The specific condition to be monitored is defined by the user via an interactive procedure which stores the definition in the monitoring apparatus. The definition is stated in terms of the elevator control elements and voltage levels. Electrical input leads to the monitoring apparatus are connected to the elevator control elements specified in the definition, and additional electrical input leads may be connected to any other elevator control elements whose status is desired to be known at the instant the defined condition is detected. More than one condition may be defined, and the same inputs may be used in the definitions of different conditions. In other words, a plurality of input leads are connected to a plurality of different elevator control elements. A plurality of different combinations of these elements may be defined to be conditions or events which are to be monitored. The on-site, unattended, monitoring apparatus continuously monitors the inputs for a match of a defined condition. Upon detecting the defined condition, it stores the status of all of the inputs, it stores the time of day, it determines and stores the total elapsed time the condition persists, and it increments a counter each time the defined condition is detected. This stored information in the monitoring apparatus is later reproduced for evaluation in a manner selectable by the user, such as on a video monitor and/or by a printer which delivers a hard, formatted copy of the data.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 4 is a display which is part of the display terminal, which shows a first user-defined condition which has been entered via the interactive procedure set forth in FIG. 3;

FIG. 5 is the display of FIG. 4 showing another user-defined condition which has been entered into the monitoring apparatus;

FIG. 6 is the display of FIG. 4 illustrating still another user-defined condition which has been input into the monitoring apparatus;

FIG. 9 is a display which is part of the portable display terminal portion of the monitoring apparatus, which sets forth the information stored in the on-site portable portion of the monitoring apparatus, relative to a selected definition of a user-defined occurrence.

DESCRIPTION OF PREFERRED EMBODIMENTS

Figure 1:
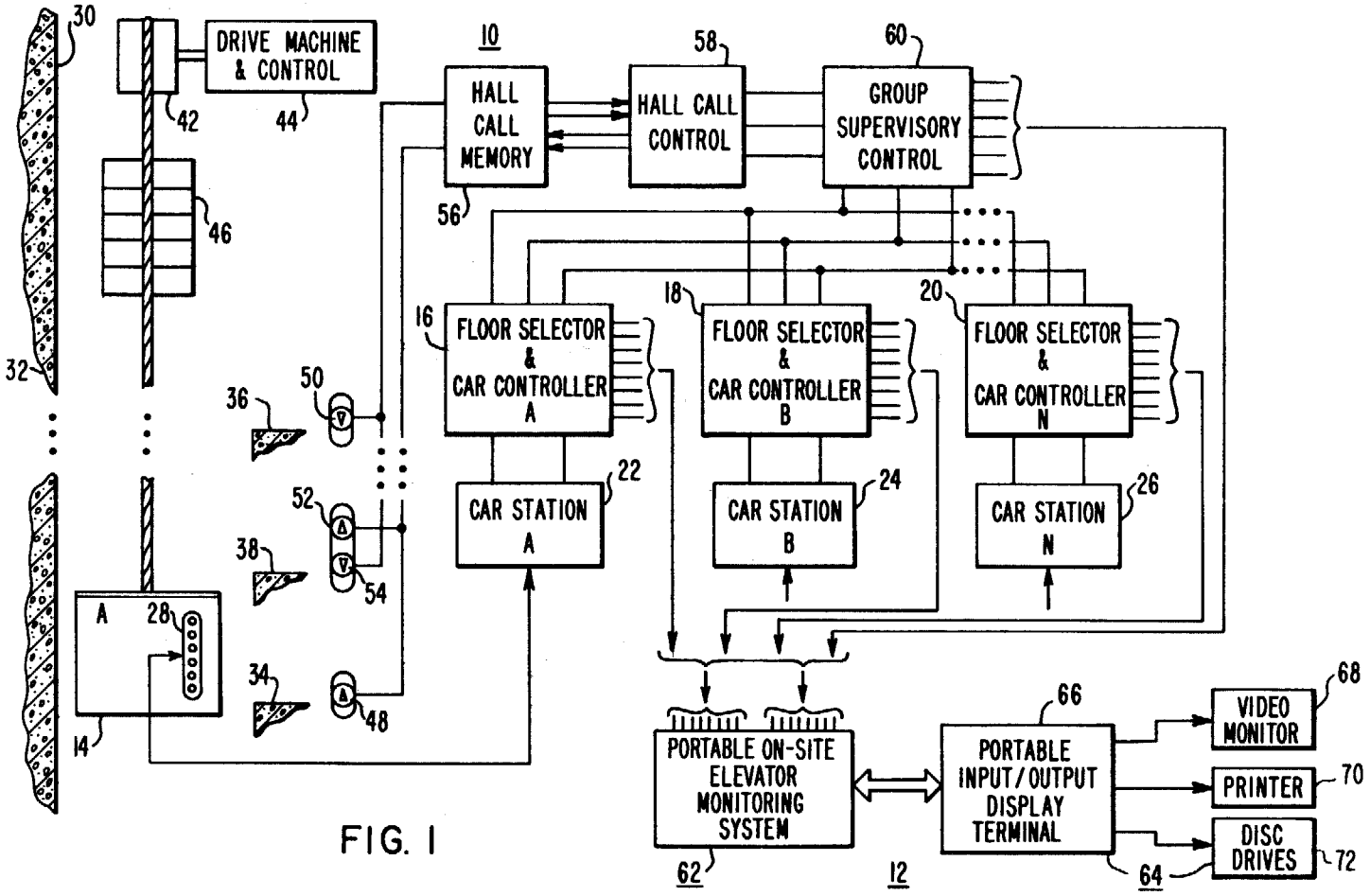
FIG. 1 is a partially schematic and partially block diagram of an elevator system being monitored according to the teachings of the invention.

Referring now to the drawings, and to FIG. 1 in particular, there is shown an elevator system 10 being monitored by monitoring apparatus 12 according to the teachings of the invention, using servicing methods which are set forth by the teachings of the invention. Since the specific details of the elevator system being monitored are immaterial, elevator system 10 is shown in block form. U.S. Pat. Nos. 3,256,958; 3,741,348; 3,902,572 and 4,007,812 all set forth relay-based elevator systems which may be monitored, for example. U.S. Pat. Nos. 3,750,850; 3,804,209 and 3,841,733 collectively set forth a solid-state elevator system which may be monitored. All of these U.S. Patents are assigned to the same assignee as the present application. For purposes of example, it will be assumed that the elevator system 10 being monitored is relay based, and that the monitoring system is microprocessor based, thus requiring a 125-volt D.C. to 5-volt D.C. interface between the elevator system 10 and monitoring apparatus 12.

More specifically, elevator system 10 may include a single elevator car, or a plurality of elevator cars under group supervisory control. The elevator cars may be hydraulically driven, or they may be of the electric traction type. For purposes of example, the controls A, B and N of a traction elevator system are illustrated with only elevator car 14 associated with control A being shown, as the other elevator cars would be similar. The elevator controls A, B and N each include a floor selector and car controller 16, 18 and 20, respectively, mounted remotely from the associated elevator car, such as in a machine room. The elevator controls A, B and N also include car stations 22, 24 and 26, respectively. Each car station includes a push button array inside an elevator car for registering car calls, such as an array 28 illustrated in elevator car 12.

The elevator cars are mounted for movement in a building to serve the floors therein. For example, elevator car 14 is mounted in a hoistway 30 of a building 32 having a plurality of floors or landings, with only the lowest floor 34, the highest floor 36, and one intermediate floor 38, being shown in FIG. 1.

Elevator car 14 is supported by a plurality of wire ropes shown generally at 40, which are reeved over a traction sheave 42 driven by a traction drive machine 44. A counterweight 46 is connected to the other ends of the ropes 40.

Hall calls from the various floors are registered by push buttons mounted in the hallways adjacent to the floor openings to the hoistway. For example, the lowest floor 34 includes an up-direction push button 48, the highest floor 36 includes a down-direction push button 50, and the intermediate floor 38 includes up and down push buttons 52 and 54, respectively. Up and down hall calls are sent to hall call memory 56 which memorizes the calls until they are reset, and it further sends the calls to hall call control 58. Hall call control 58 sends the hall calls to the group supervisory control 60.

The group supervisory control 60, using information provided to it from the various elevator cars relative to their position and activity level, determines the allocation or assignment of the hall calls to the cars, according to a predetermined operating strategy.

Malfunctions in elevator system 10 may be car related and/or system related. While certain malfunctions are easy to diagnose, others, such as intermittents, are difficult and time consuming to troubleshoot. Monitoring apparatus 12, which uses apparatus and servicing methods according to the present invention, greatly facilitates the servicing of elevator systems as it permits the simultaneous monitoring of a large plurality of user-defined combinations, on a continuous, 24-hour-a-day basis. Information concerning the occurrences of the user-defined conditions or events is stored, and reproduced upon command, via a user-selected mode, for easy analysis and troubleshooting. More specifically, monitoring apparatus 12 includes a first portable portion 62 which remains on site during the monitoring period, and a second portable portion 64. The second portion 64 is used at the start of the monitoring period, during the initial setup of portion 62, and also at the end of the monitoring period, to communicate with portion 62. Portion 64 includes a portable input/output display terminal 66 having a keyboard 120 for providing input information. Display terminal 66 additionally may include such auxiliary apparatus as a video monitor 68, a printer 70, and disc drives 72.

Figure 2A:
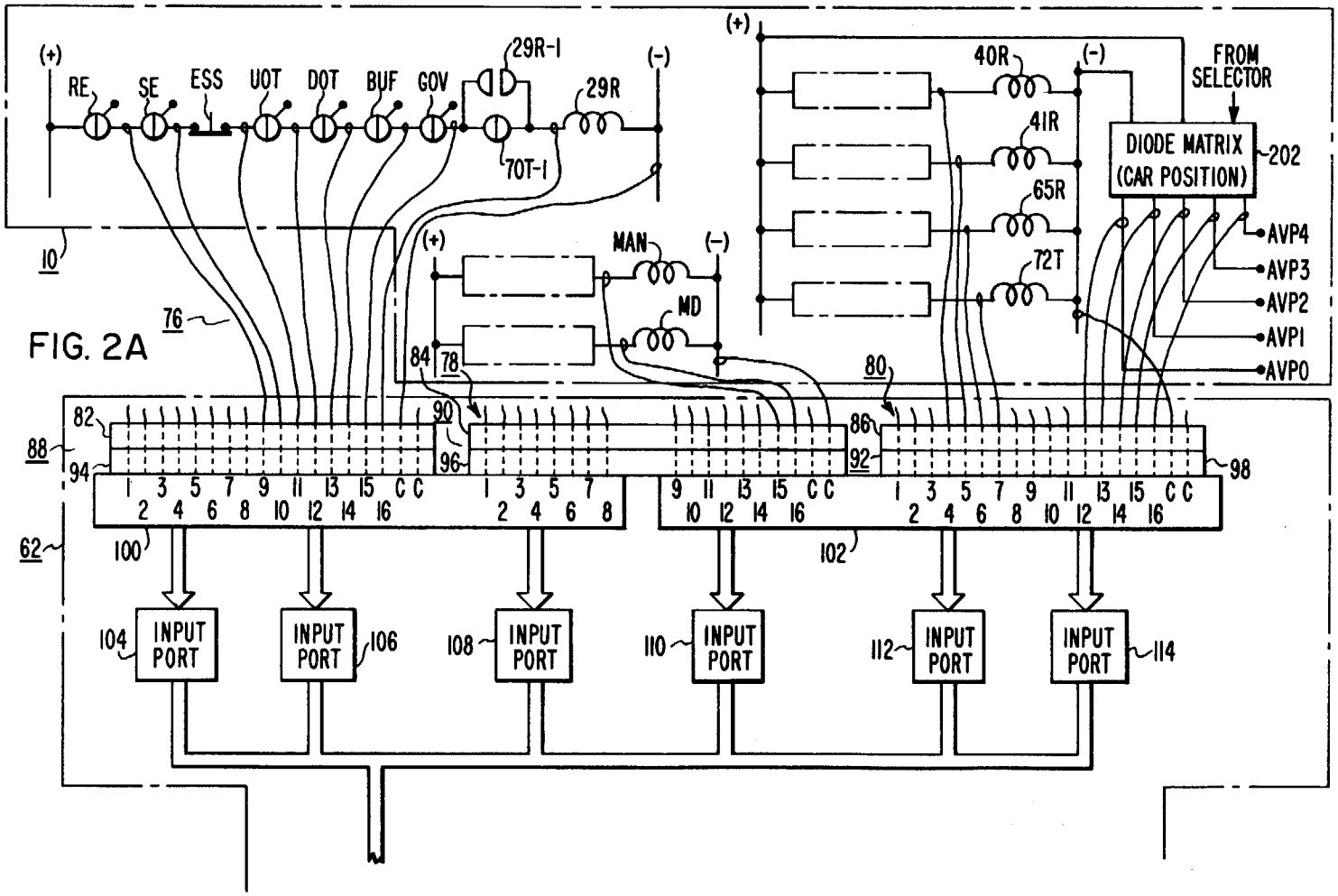
FIGS. 2A and 2B may be assembled to set forth a detailed schematic and block diagram of the monitoring apparatus shown in FIG. 1, along with exemplary connections thereof to various elevator control elements.
Figure 2B:
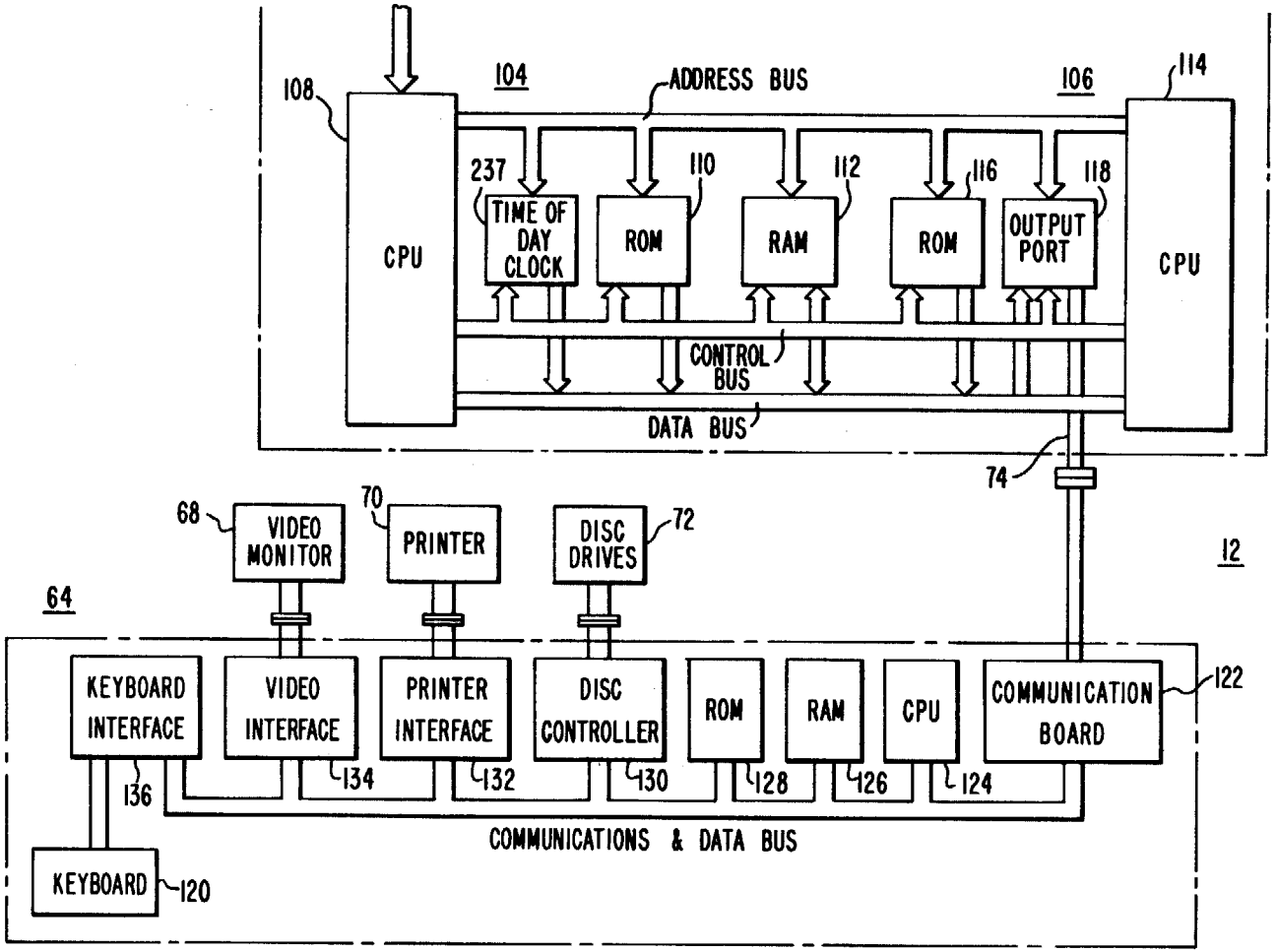

FIGS. 2A and 2B may be assembled to set forth a detailed schematic and block diagram of monitoring apparatus 12, illustrating exemplary connections thereof to monitor various combinations of elevator control elements in elevator system 10. When an elevator system is to be monitored, service personnel bring the monitoring apparatus 12 to the control room of the elevator system 10, and they interconnect the two portable portions 62 and 64, such as via a RS232 data link 74.

The first portion 62 includes a plurality of cables each having a plurality of electrical leads. For purposes of example, three cables 76, 78 and 80 are shown, each having sixteen electrical leads for connection to elevator control elements, and additional ground leads. First ends of the leads of cables 76, 78 and 80 are connected to first portions 82, 84 and 86, respectively, of suitable electrical connectors 88, 90 and 92, respectively. The second ends of the leads include quick connectors for securely attaching the leads to various control points, such as to electrical wires, electrical contacts, electrical terminals, and the like.

Second portions 94, 96 and 98 of the electrical connectors 88, 90 and 92, respectively, are attached to interface boards 100 and 102 which convert the 125-volt D.C. of the relay-based elevator system 10 to 5 volts D.C. for use by the monitoring apparatus 12. If the control of the elevator system 10 operates with the same voltage levels as used by the monitoring apparatus 12, the voltage change interface boards 100 and 102 would not be required.

The low-voltage outputs of the interface boards 100 and 102 are brought out to a plurality of 8-bit input ports 104, 106, 108, 110, 112, 114 and 116, such as Intel's 8212, with these input ports being monitored for a change in a voltage level of any one of the electrical leads.

In a preferred embodiment of the invention, the monitoring of the input ports is performed by a dedicated microprocessor, and a second microprocessor utilizes the data collected by the first microprocessor to store information relative to the occurrences of the user-defined conditions. It is to be understood that the first microprocessor may be eliminated, if desired, with hardware interrupts being used to signify an input change, or, the second microprocessor may be additionally programmed to periodically check the input ports for a signal change.

More specifically, in the preferred embodiment, a first microprocessor 104 monitors the input ports, and a second microprocessor 106 processes the data as it is updated by the first microprocessor 104. The first microprocessor 104 includes a CPU 108, such as Intel's 8085A, which includes a clock generator and system controller on the same chip, a ROM 110, such as Intel's 8755A/8755A-2 16,384-bit EPROM with I/O, and a ROM 112, such as Intel's 8156, which includes I/O ports and a timer. CPU 108 detects a change in a signal at an input port and stores the change in RAM 112.

The second microprocessor 106 shares RAM 112 with the first microprocessor 104. It additionally includes a CPU 114, which may be Intel's 8085A, a ROM 116, which may be Intel's 8755A/8755A-2, and an output port 118, such as Intel's 8212. Output port 118 is connected to the RS232 data link 74. The first and second microprocessors 104 and 106 may be mounted on Intel's 80/24 boards.

The second portable portion 66 of the monitoring apparatus 12 may be the APPLE II, for example, because of its easy portability and availability of the desired auxiliary devices. The APPLE II incorporates an integral keyboard 120, and the desired auxiliary devices, such as video monitor 68, printer 70 and disc drive 72, are readily plugged into suitable interfaces for these devices. The APPLE II includes a communication board 122 connected to the RS232 data link, a CPU 124, a RAM 126, a ROM 128, a disc controller 130 for disc drive 72, a printer interface 132 for printer 70, a video interface 134 for video monitor 68, and a keyboard interface 136 for the keyboard 120.

Portion 64 of monitoring apparatus 12 includes a program in ROM 128 for entering information into RAM 112 of portion 62 of the monitoring apparatus 12. A flow chart for this program is set forth in FIG. 3. Once the intermittent monitoring mode is selected by an appropriate input via keyboard 120, the program directs an interactive exchange between the user and program, with the video monitor 68 conveying information from the program to the user, and with the video monitor also displaying the entered information in order to assure its correctness. Once a user-defined condition is entered and verified, it is sent to portion 62 via the RS232 data link for storage and use by portion 62 of the monitoring apparatus during the subsequent monitoring of the elevator system 10. After the desired information is entered by the user and verified, portion 64 of the monitoring apparatus may be disconnected from portion 62 and removed from the building for use with other monitoring portions 62 in other buildings.

Figure 3:
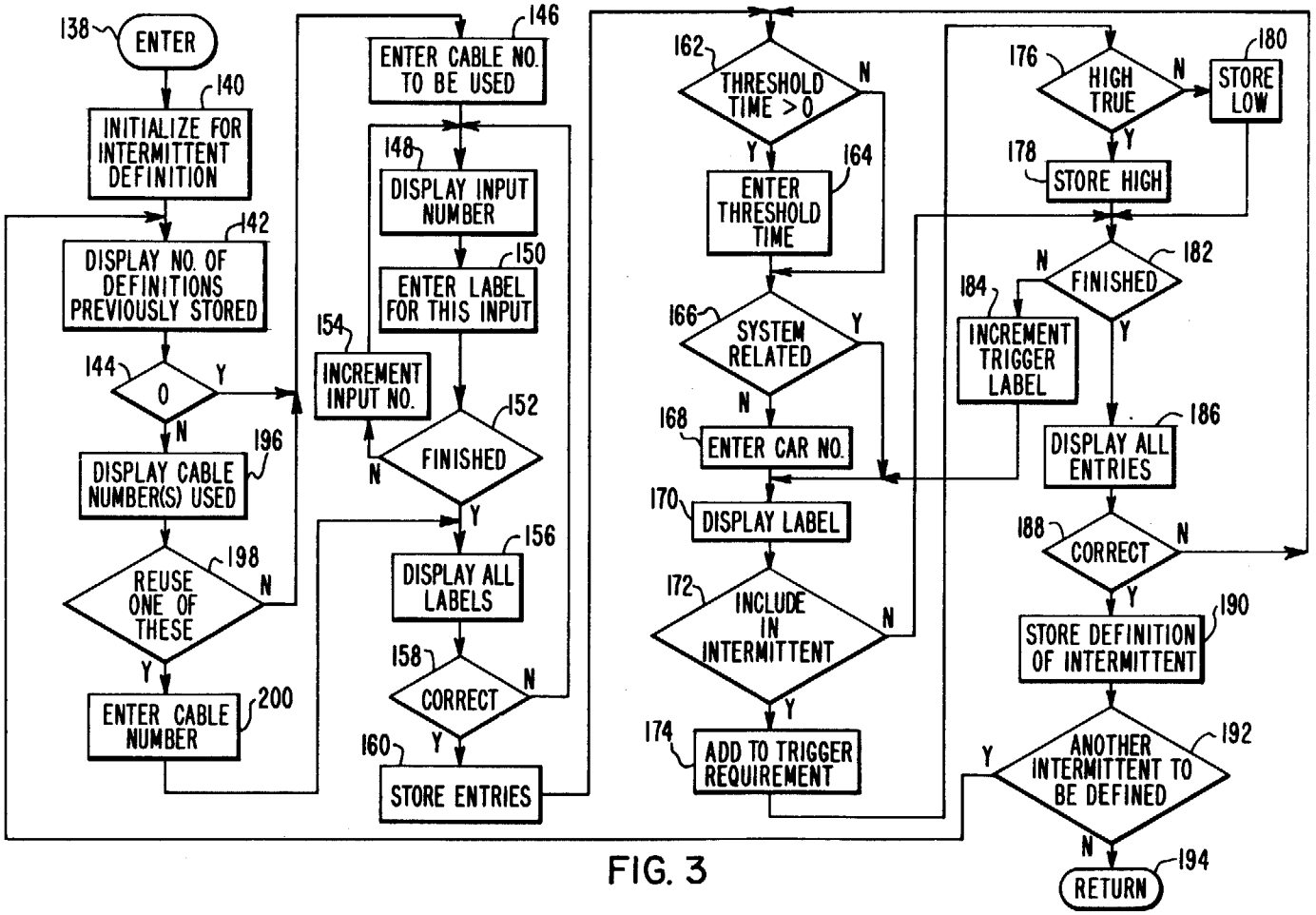
FIG. 3 is a flow chart which sets forth an interactive procedure followed by the user and monitoring apparatus during the process of entering user-defined conditions to be monitored into the portable on-site monitoring apparatus via a portable input/output and display terminal.

More specifically, the interactive information exchange program shown in FIG. 3 is entered at 138, and step 140 performs the necessary initializing steps. Step 142 displays the number of definitions previously stored. If this is the initial use and setup of the monitoring apparatus at this site, the number will be zero. If definitions have already been entered for this site, it will display the number of such definitions. Step 144 checks to see if the number is zero. In this particular pass through the program it will be assumed that the number is zero, and the program advances to step 146.

Step 146 may request that the user enter the cable number to be used for the soon-to-be defined condition, or the program may assign a cable number to be used, as desired. As hereinbefore set forth, it will be assumed that there are sixteen active inputs in each cable which may be used to monitor various elevator control elements. Step 148 displays the number 1, corresponding to the first active input lead of the selected cable. The input leads or wires are suitably marked or coded such that input lead 1 is readily identifiable, as well as the numbers of the remaining electrical leads. When input number 1 is displayed on the video monitor, step 150 directs that the user enter a label for input wire 1, to identify the elevator circuit element which this lead will be connected to monitor, or has already been connected to monitor, as desired. For example, the video monitor may display "signal 1 name is?". If lead number 1 will not be used, the "return" button on the keyboard 120 will be pressed by the user, and input number 1 will not be labeled. Upon entry of a label, or upon pressing "return", step 152 checks to see if all sixteen inputs have been presented. If not, step 154 increments the input number and the program returns to step 148. The program remains in this loop until all sixteen inputs have been processed. When step 152 finds that the sixteen inputs have been presented, step 156 displays all of the labels which have been entered, adjacent to their associated electrical lead numbers. Step 158 asks the user if this display is correct. If the user enters "no", because an error is detected, the program returns to step 148. If the entries are correct, and each is associated with the proper lead number, a "yes" is entered and step 160 stores the entries. FIG. 4 is a fragmentary view of video monitor 68 setting forth a format which may be used for an intermittent definition assigned to cable 76 (also referred to as cable number 1). In this definition, leads 9 through 16 are assigned labels, and these leads should be connected to monitor the identified switches, contacts, or relays, as will be hereinafter explained. FIGS. 5 and 6 are views of a video monitor which display exemplary intermittent definitions for cables 80 and 78, respectively, (also referred to as cables 3 and 2). The definitions set forth in FIGS. 5 and 6 will also be hereinafter described in detail.

Returning now to FIG. 3, step 160 advances to step 162 which checks the user to determine if a threshold time is to be assigned. Some intermittent conditions to be monitored will indicate a malfunction the instant the defined triggering element, or combination of elements, have the specified states. Thus, the threshold time for such an intermittent will be zero. Other intermittent conditions to be monitored may specify a combination which occurs normally, but if the combination persists beyond a predetermined period of time, it indicates a malfunction. Thus, if the intermittent is of the latter type, in response to the question of step 162, the user will enter a "yes" and step 164 requests the user to enter a value for the threshold time. While not specifically shown, it will be obvious how a threshold time may also be used to define a minimum time for a specified element, or combination of elements.

Step 166 checks the user to see if the intermittent being defined is related to a system condition, i.e., a condition common to all of the elevator cars, or, if it is related to a specific elevator car. If "no" is entered to enter a car-related condition, step 166 advances to step 168 which requests that the associated car number, or car letter, be entered. Step 168 then advances to step 170. If a "yes" is entered to indicate a system condition, step 166 advances directly to step 170.

Step 170 begins a program phase which involves the user defining which one, or which combination, of the labeled inputs is to trigger an occurrence of the intermittent condition, when this one element, or combination of elements, has a predetermined state or voltage level. The predetermined state is also entered during this phase of the program. Step 170 displays the first label and its associated electrical lead number, and step 172 asks the user if this label is to be included in the intermittent definition. If a "yes" is entered, step 174 adds this label to the "trigger" requirement, and step 176 asks the user if the voltage level to be included as part of the intermittent definition is high true. In other words, should voltage appear on this lead when the intermittent occurs? If the answer "yes" is entered, step 178 stores a "high". If the answer "no" is entered, step 180 stores a "low". Step 182 checks to see if all labels have been processed. If not, step 184 increments the list of trigger labels, and the program returns to step 170. If step 182 finds all labels processed, the program advances to step 186 which displays all entries on the video monitor, to determine if the entries starting with step 162 are correct. FIGS. 4, 5 and 6 set forth different examples of an entry format which may be used at this point. If the user enters "no", the program returns to step 162. If the user enters "yes", step 190 stores the displayed entries. The program may now ask the user at step 192 if another intermittent is to be entered, or the program may simply end with step 190. If the program ends with step 190, and the user wishes to enter another intermittent condition, the same entry which started the program at step 138 will now be made. If step 192 is included, and the user enters a "yes", the program returns to step 142. If a "no" is entered, the program ends at terminal 194.

If a previous intermittent definition has been entered, step 144 will find the answer is not zero, and the program will advance to step 196 which displays the cable numbers which have been previously used. Step 198 asks the user if one of these cables is to be re-used. If a "no" is entered, the program advances to step 146. If a "yes" is entered, step 200 asks the user to enter the cable number, and the program advances to step 156.

Returning to FIG. 2, it will be assumed that cable 76 (cable 1) is to monitor for a malfunction which causes the relay 29R of car 12, i.e., the safety relay, to drop. Relay 29R monitors a large plurality of elements, requiring the associated contacts to all be closed in a serial string, before relay 29R will pick up to allow the associated elevator car to run. The dropping of relay 29R may be an intermittent condition if the cause is such that the contact recloses after the cause is corrected. For example, if someone lifts the roof exit panel, to cause a monitoring switch RE to open, relay 29R will drop to stop the car. If this panel is reclosed, relay 29R will pick up again to allow the car to run. Contact 70T-1 is a contact from the non-interference time relay 70T. Thus, once the non-interference time has expired and relay 70T drops, relay 29R will pick up if all of the contacts in the serial string are closed. Once relay 29R picks up, it closes its contact 29R-1 which seals in around contact 70T-1.

An intermittent condition may also be triggered by the operation of the emergency stop switch ESS, and also by an opening of the side exit which opens switch SE. Other switches in the serial string, such as the overtravel swicth UOT, which detects overtravel in the up direction, or the overtravel switch DOT, which detects overtravel in the down direction, or the buffer switch BUF, which detects that the buffer is not properly extended, or the governor switch GOV, which indicates that the governor is not set, will not automatically reclose after opening. Thus, if these contacts open to drop relay 29R and stop the car, the car will not run until authorized personnel determine the cause of the malfunction and correct it.

In the intermittent condition to be checked by cable 76 (cable 1) the triggering condition is simply no voltage on relay 29R. Thus, as shown in FIG. 4, if wire 16 is connected to be responsive to voltage on relay 29R, input 16 will have the label 29R, and an "X" will be placed in the row of input 16, under the column heading "trigger", to denote that this is a trigger element. The word "low" will also be placed in this row, under a column heading "mode", to indicate that no voltage on this element is the triggering level. As will be hereinafter described, when relay 29R drops, the status of all of the other labeled inputs will be stored at the instant relay 29R is deneergized. Electrical leads 9 through 15 are connected as shown in FIGS. 2A and 2B to monitor the voltage level of its associated circuit element, and a ground or common wire will be connected to the negative bus. Thus, if someone opens the roof exit, switch RE will open and all elements will have a low state at the time relay 29R drops which initiates the storing of the voltage level or status of each input. Since all elements being monitored will have a low state only when switch RE opens, the user will know that switch RE triggered the drop of relay 29R. As will be hereinafter described, the number of times relay 29R drops will be counted, the time of day of each occurrence will be recorded, and the elapsed time that relay 29R is dropped out during each occurrence will be determined and stored. All of the stored information is later reproduced for the user, at the user's command, as will also be hereinafter described.

Returning to FIGS. 2A and 2B, cable 80 (cable 3) is connected to be responsive to an intermittent condition relative to car A which checks to see if the elevator car is running when a door interlock is not "made". Thus, electrical lead 4 may be connected to monitor the voltage of a relay 40R, or to monitor a contact of relay 40R, as desired. The "mode" should be entered as "low", or zero, if triggering on an opening contact, and "high", or one, if triggering on a closing contact. A "zero" status will be entered for a non-triggering input, if the contact is open at the time the intermittent occurs, and a "one" indicates that the contact was closed at the time the intermittent occurred. Relay 40R should only be deenergized when the car door interlock is not made. Once this interlock is made, indicating the car door is closed and locked, relay 40R will be energized. Electrical lead 5 may be connected to monitor the voltage on the hatch door relay 41R, or to monitor a contact of relay 41R, as desired. This relay is only energized when the hatch door is closed and locked. Electrical lead 6 may be connected to monitor the voltage on the running relay 65R which is energized when the elevator car is running. Electrical lead 7 may be connected to monitor the voltage of the leveling protective relay 72T, which picks up when releveling is necessitated. Wires 12 through 16 may be connected to a car position indicator, such as a diode matrix 202, which may be part of the floor selector and car controller 16 for car 12. Electrical leads 12 through 16 monitor a signal AVP0-AVP4, which indicates the floor position of the elevator car in binary.

As shown in FIG. 5, the combination which triggers the occurrence of an intermittent condition may be relay 40R low, i.e., not energized, indicating that the car door is not closed and locked, and relay 65R high, or energized, indicating the elevator car is running. When this combination occurs, the status or voltage level of the other inputs at the instant of the occurrence will also be stored. Thus, the specific location of the elevator car at the time of this occurrence is known from the signals AVP0-AVP4. If the problem is associated with a specified floor, the user need not check the interlocks of all of the floors, as the faulty floor interlock is pinpointed. Other intermittent combinations may be chosen, using any of the signals set forth relative to cable 80. For example, another intermittent may be defined which uses the hatch door relay 41R and the running relay 65R. Another intermittent may wish to obtain information only when the elevator car is located at the main floor, for example. Thus, signals AVP0-AVP4 would be included in the definition of the intermittent, with the mode thereof setting forth the binary address of the main floor. The elements to be checked while the elevator car is located at the main floor, if not already included in the listing set forth in FIG. 5, would be added thereto at the time of the interactive exchange set forth by the flow chart shown in FIG. 3.

Returning to FIGS. 2A and 2B, cable 78 (cable 2) is connected to be responsive to an intermittent condition which is system related, and, as shown in FIG. 6, which displays an intermittent definition for cable 78, the defined intermittent must exist for four seconds before it counts as an occurrence of the intermittent. For example, lead number 15 may monitor voltage on the master available car relay MAN, which is picked up when there is an avialable car, i.e., an elevator car available for an assignment from the group supervisory control 60. Lead number 6 may monitor voltage on the master demand relay MD, which is picked up whenever there is a demand in the system for an available car. If there is an available car, and a demand for an available car, these two relays will be energized simultaneously. However, they should normally be energized simultaneously for only a short period of time, as the group supervisory control 60 should assign the available car to a demand, and when this occurs, the master available car relay will drop out. If there are move available cars than demands, then the master available car relay will be energized, but the master demand relay will be dropped out. Thus, if the group supervisory control 60 does not function to drop out one or the other of these two relays within a predetermined period of time, it indicates a malfunction in the group supervisory control. Thus, as shown in FIG. 6, relays MAN and MD will both be included in the triggering definition, and the triggering states will be high, indicating that both relays are to be energized. The threshold time is set for some suitable period of time, such as four seconds, indicating that the occurrence of this specific condition should only be counted, and information permanently stored relative thereto, if relays MAN and MD are energized simultaneously for four seconds, or greater.

Figure 7:
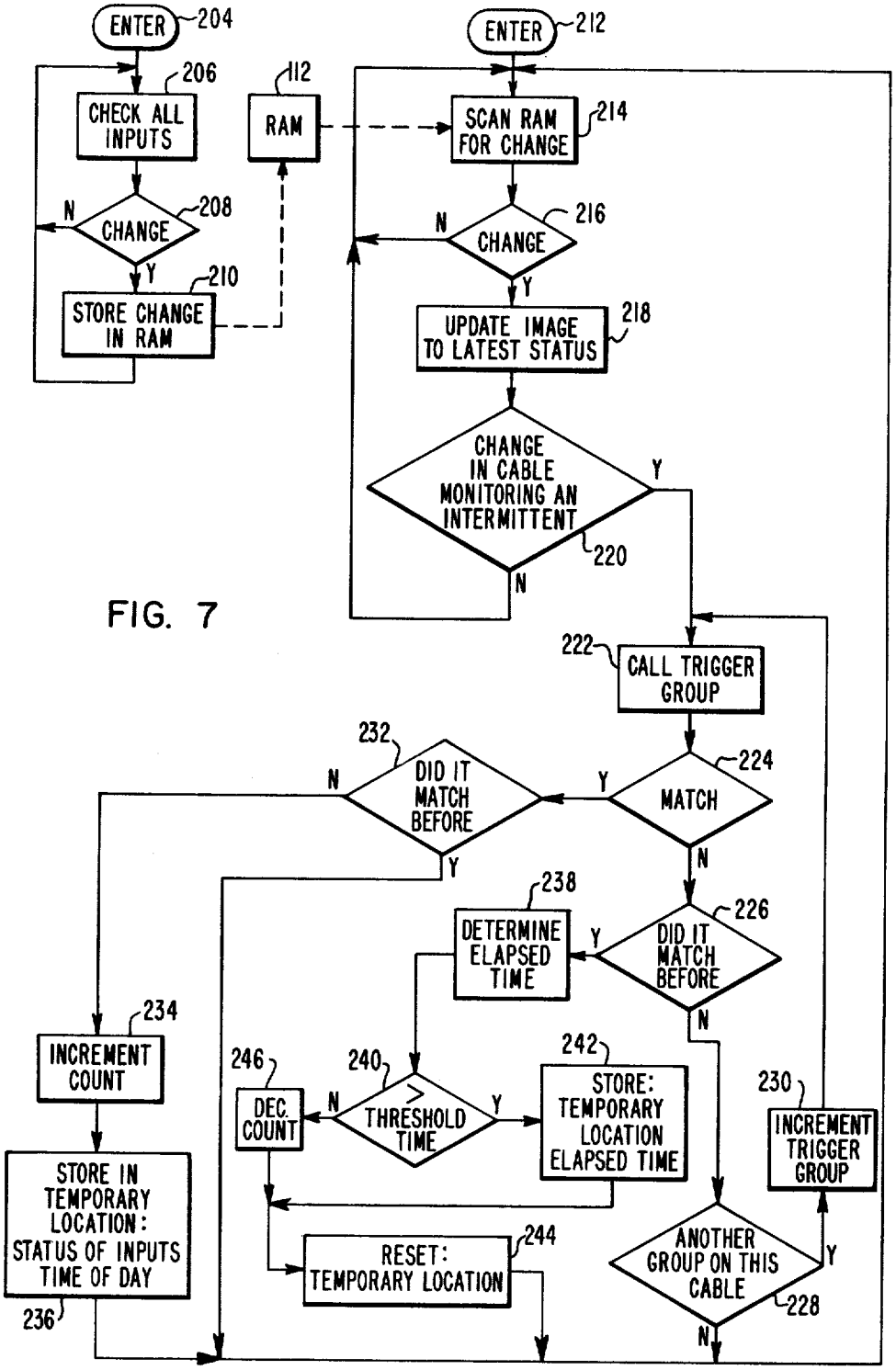
FIG. 7 is a flow chart which sets forth a program followed by the portable on-site portion of the monitoring apparatus during its continuous monitoring of the inputs from the elevator system.

Once information relative to an intermittent condition, or conditions, has been entered by the user in portion 64 of the monitoring apparatus, and portion 64 has transferred this information to portion 62, portion 62 performs a continuous, on-site, 24-hour-a-day monitoring of the elevator system 10. The monitoring apparatus 12 continuously looks for an occurrence of the defined intermittent condition, or defined intermittent conditions. The program followed by microprocessors 104 and 106 is set forth in FIG. 7. The program followed by microprocessor 104 is entered at 204 and it sequentially addresses the input ports 104, 106, 108, 110, 112 and 114 at step 206. After each port is addressed, step 208 determines if there has been a change in the voltage levels of the various inputs at this port since the last reading thereof. If not, the program returns to step 206 and it stays in this checking loop until step 208 detects the change. Step 210 stores any change in the common RAM 112, to provide an up-to-date image of the input signals.

Microprocessor 106 follows a program which starts at 212, and step 214 scans the image of the input ports in RAM 112. Step 216 determines if an input has changed since the last scan. If not, the program loops back to step 214. If a change occurs, step 218 updates its own image of the input ports which it maintains for comparison purposes, and step 220 determines if the change has occurred on a cable which is monitoring for intermittent conditions, as certain cables may be used for other monitoring purposes. If the answer is "no", the program loops back to step 214. If the answer is "yes", step 222 calls the first trigger group associated with the cable on which the change occurred. Step 224 determines if the change has caused the trigger inputs to match the definition called. If it does not match, step 226 determines if these inputs matched this trigger group previously. If the answer is "no", step 228 checks to see if all the trigger groups of all of the intermittent conditions associated with this cable have been checked for a match. If not, step 230 increments the trigger groups and returns to step 222. When step 228 finds all groups have been checked without a match now, or a previous match, the program returns to step 214.

If step 224 finds that the inputs to this cable match the trigger definition of the intermittent condition being checked, step 224 goes to step 232. Step 232 checks to see if it matched before. If it did not, this indicates the start of the intermittent condition. If the answer to step 232 is "yes", this intermittent was previously noted and it is still continuing. If it is the very start of an intermittent, step 232 goes to step 234 which increments a counter associated with the intermittent definition being processed, and step 236 reads and stores the status of all of the labeled electrical leads of the cable in question, i.e., it stores a 1 if voltage is detected, and it stores a zero if there is no voltage. Step 236 also notes and stores the time of day from a time-of-day clock 236 shown in FIG. 2. The status of the input leads and time-of-day information is stored in a temporary location by step 236, as it is not known at this point if the recognized intermittent condition must persist for a predetermined threshold time before it is to be saved for later reproduction.

Step 236 then returns to step 214, where it loops through steps 216, 218 and 220 until another signal level change is detected in a cable which is monitoring intermittents. It will be assumed that a change is now detected which signifies the end of the intermittent condition previously noted. Thus, step 224 will find that the present combination of inputs being checked does not match the defined intermittent, but step 226 will find that it matched the previous time this intermittent condition was checked. Thus, the intermittent condition has ended and step 226 advances to step 238 which determines the total elapsed time of the intermittent condition by using the time of day stored by step 236 and the present time of day. Step 240 determines if the elapsed time exceeds the threshold time entered in step 164 of FIG. 3. If the threshold time was zero, or if non-zero and the elapsed time exceeds it, step 240 goes to step 242 which stores the status and time-of-day information stored at the temporary location, in a location which will save the information for later reproduction. Step 242 also stores the elapsed time of this occurrence of the intermittent condition. Step 242 then goes to step 244 which resets or clears the temporary storage location, to prepare for the next occurrence of this intermittent condition.

If step 240 finds the elapsed time does not exceed the threshold time, it advances to step 246 which decrements the count, and step 246 goes to step 244 to clear the temporary location.

Portion 62 of monitoring apparatus 12 continues to monitor and log information relative to the defined intermittent conditions until the user returns to the site of the elevator system and retrieves the stored information for analysis. The user brings the second portable portion 64 of the monitoring apparatus 12 to the site and the RS232 data link 74 is reconnected to the first portable portion 62. Information is entered via the keyboard 120 which calls the program for reproducing the stored information. The flow chart for this program is set forth in FIG. 8.

More specifically, the retrieval program is entered at 250 and step 252 displays the number of intermittent conditions which have been defined. Step 254 then displays a list of the intermittent conditions and their associated cable number. The program, in step 256, then asks the user, via the video monitor, to enter a selection for one of the intermittent conditions. Step 258 displays the definition of the selected intermittent condition, which may be in the format of the definitions shown in FIGS. 4, 5 and 6. FIG. 9 is a view of video monitor 68 as it might appear during the retrieval of information relative to the intermittent condition defined and set forth in FIG. 5. If the video monitor is not large enough to display all of the information simultaneously, it may do so sequentially. Step 260 displays the number of times this intermittent condition has occurred, using the associated counter kept up to date by steps 234 and 246.

As illustrated in FIG. 9, it will be assumed that this intermittent condition occurred two times. Step 262 then displays the starting time and duration of the first occurrence, which is shown as starting at 12:48:47 A.M. and lasting for 250 msec. Step 264 then lists all inputs associated with this particular cable and it also lists the labeled inputs relative to the various electrical leads. The listing shows that the elevator car was running, i.e., relay 65R was energized, that the elevator car was not re-leveling, i.e., 72T was deenergized, that neither the car door nor hatch door interlocks were made, i.e., relays 40R and 41R were both deenergized, and that this occurred at the floor whose binary address is 00001.

Step 264 then advances to step 266 to determine if all occurrences have been reproduced. If not, step 268 increments "occurrences" and steps 262 and 264 are repeated for the next occurrence. To conserve memory, the program may be arranged to save detailed information relative to only the last N occurrences, such as eight, while the count will give the exact number of times that the associated intermittent condition occurred.

When step 266 finds that all of the occurrences for which detailed information has been stored have been processed, step 270 asks the user if a hard copy of the information is desired. If so, step 272 prints the information. If desired, the information retrieval program may simply print out a hard copy of all information stored since the monitoring was initiated.

Figure 8:
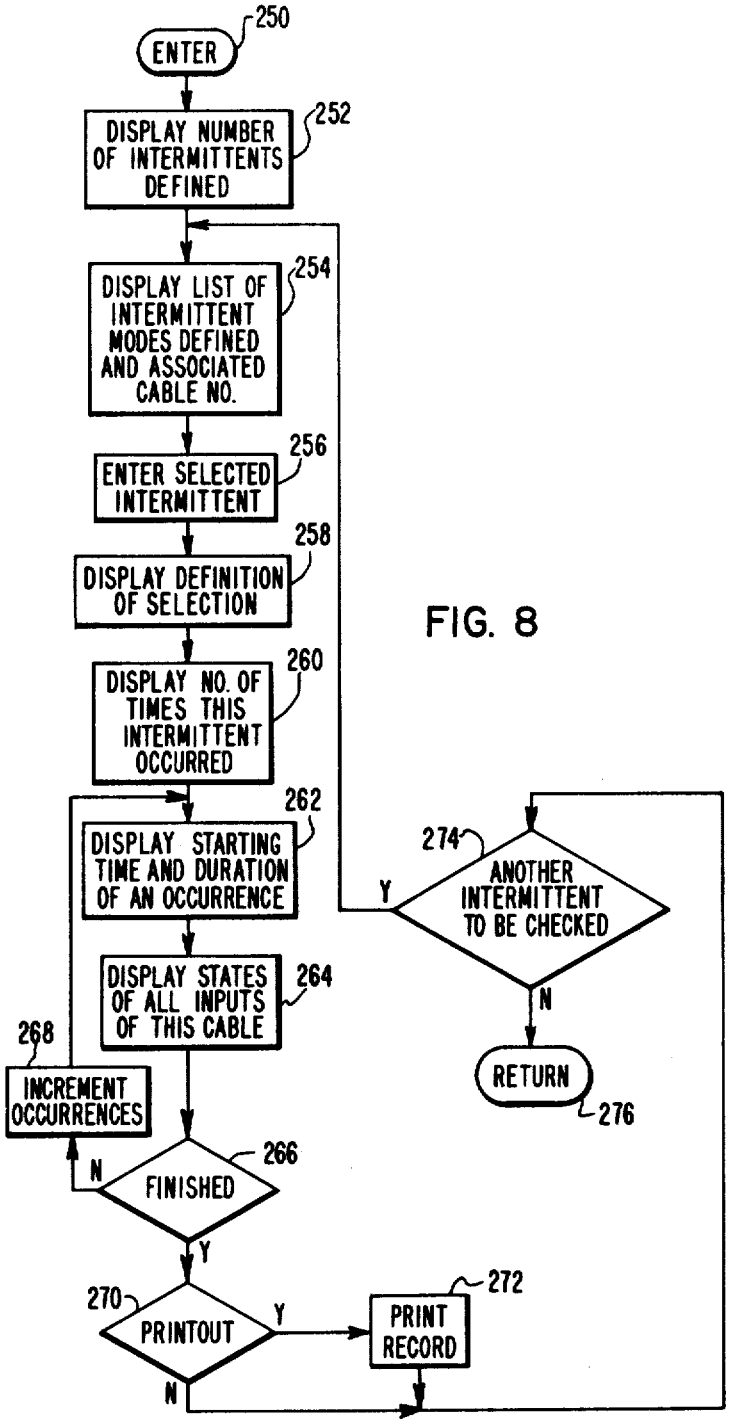
FIG. 8 is a flow chart which sets forth a program which directs an interactive procedure used during the retrieval, display and/or printing of the information via the portable input/output display terminal, using the information stored in the on-site portion of the monitoring apparatus.

The retrieval program may end after step 272. If the user wishes to obtain information relative to another intermittent condition, the retrieval program would simply be recalled and another selection made. Or, as shown in FIG. 8, the program may include step 274 which asks the user if another intermittent condition is to be checked. If so, the program returns to step 254. If not, the program ends at 276.

Thus, as set forth in the various figures and programs, the invention discloses new and improved methods of servicing an elevator system which include the steps of providing monitoring means which includes memory or storage means for logging information relative to detected intermittent conditions, and a plurality of input leads for connecting the monitoring means to detect voltage levels. These voltage levels may signify whether a relay is energized or deenergized, and they also may be used to indicate whether or not a contact is open or closed. The methods further include the step of storing definitions in the memory means, which definitions are associated with control elements of the elevator system. The methods then involve selecting which control elements of the stored definitions, and the states thereof, i.e., energized/deenergized, or open/closed, which are to signify the occurrence of an event by the simultaneous occurrence of the specified states. The trigger elements, in effect, are AND'ed and when the defined trigger states simultaneously exist, an output is provided to signify the occurrence of the defined intermittent condition. The new and improved methods further include the steps of connecting at least certain of the plurality of input electrical leads as defined by the intermittent definition, to be responsive to the state of the associated control element. The monitoring means then performs a detecting or AND'ing step, to detect the occurrence of a defined event. Upon such detection, the methods include the steps of storing the fact that the event occurred, and reproducing the information stored by the storing step relative to the occurrence of the event. The reproducing step is performed in a manner selectable by the user.

The invention also discloses new and improved monitoring apparatus for aiding in the servicing of an elevator system, with this new and improved apparatus including a plurality of individually identifiable input leads which are connectable to be responsive to the states of selectable control elements of the elevator system. The apparatus further includes storage means, such as a RAM, for storing information relative to which of the plurality of input leads are to be connected to be responsive to specified control elements of the elevator system, and which of the specified control elements, and their conditions or states, which are to be trigger combination for triggering the detection of an event or intermittent condition. The new and improved apparatus further includes means for detecting the existence of the trigger combination, means for storing the fact that the defined trigger combination has been detected, and means for reproducing the information stored relative to such detection.

We claim as our invention:

1. A method of servicing an elevator system having a plurality of control elements operable between first and scond states, comprising the steps of:

providing monitoring means having storage means and a plurality of input leads, storing definitions in the storage means to said monitoring means for at least certain ones of said plurality of input leads, with each of said definitions being associated with a control element of the elevator system, selecting which control elements of the stored definitions, and the states thereof, are to signify the occurrence of an event by the simultaneous occurrence of the specified states, connecting said at least certain ones of said plurality of input leads to be responsive to the state of the associated control element set forth in the storing step, detecting the occurrence of the event defined in the selecting step, storing the fact that the event occurred, and reproducing the information stored by the storing step relative to the occurrence of the event.

2. The method of claim 1 wherein the step of storing events additionally stores the states of all of the connected input leads at the instant the detecting step detects the occurrence of the defined event.

3. The method of claim 1 including the step of counting the number of times the detecting step detects the occurrence of an event, and the reproducing step reproduces the count.

4. The method of claim 1 including the step of storing the time of day when the detecting step detects the occurrence of an event.

5. The method of claim 1 including the step of determining the length of time the event detected by the detecting step persists, and the storing step additionally stores the determined time.

6. The method of claim 1 including the steps of storing the time of day when the detecting step detects the occurrence of an event, and determining the length of time the event detected by the detecting step persists, and wherein the storing step additionally stores the determined time.

7. The method of claim 1 including the steps of storing a threshold time for the event to be detected, determining the length of time the event detected by the detecting step persists, and discarding events, prior to the reproducing step, which do not meet the threshold time test.

8. The method of claim 1 wherein the reproducing step includes the step of displaying the stored information on a video monitor.

9. The method of claim 1 wherein the reproducing step includes the step of printing a hard copy of the stored information.

10. The method of claim 1 wherein the steps of storing definitions and selecting control elements includes the steps of requesting and supplying information on an interactive, step-by-step basis, wherein the monitoring means is provided with means for performing the information requesting steps.

11. The method of claim 1 wherein the reproducing step includes the steps of connecting reproducing means to the monitoring means, and requesting the monitoring means to transfer the stored information relative to the event to the reproducing means.

12. The method of claim 1 wherein the reproducing step, in addition to reproducing the information relative to the occurrence of the event, additionally reproduces the stored definition and which of the control elements, and their states, are to signify the occurrence of the event.

13. The method of claim 1 including the steps of storing a threshold time for the event to be detected, determining the length of time the event detected by the detecting step persists, and discarding events, prior to the reproducing step, which do not persist for the selected threshold time.

14. A method of servicing an elevator system having a plurality of control elements operable between first and second states, comprising the steps of:

providing monitoring means having storage means and a plurality of input leads, storing definitions in the storage means of said monitoring means for at least certain ones of said plurality of input leads, with each of said definitions being associated with a control element of the elevator system, selecting at least one control element of the stored definitions, and its state, which is to signify the occurrence of an event by the occurrence of the specified state, connecting said at least certain ones of said plurality of input leads to be responsive to the state of the associated control element set forth in the storing step, detecting the occurrence of the event defined in the selecting step, storing the states of all of the inputs to the connected input leads in the storage means, upon detection of the event by the detecting step, and reproducing the information stored by the storing step.

15. Apparatus for aiding in the servicing of an elevator system having a plurality of control elements operable between first and second states, comprising:

a plurality of individually identifiable input leads connectable to be responsive to the states of selectable control elements of the elevator system, means for storing information relative to which of the plurality of input leads are to be connected to be responsive to specified control elements, and which of the specified control elements, and their states, are to signify the occurrence of an event by the simultaneous occurrence of their specified states, means for detecting the occurrence of the event when the input leads are connected as specified in the stored information, means for storing the fact that the event has been detected, and means for reproducing the information stored relative to the detection of the event.

16. The apparatus of claim 15 including means for storing the states of all of the connected input leads at the instant the detecting means detects the occurrence of the event.

17. The apparatus of claim 15 including counter means for counting the number of times the event is detected, with the means for reproducing also reproducing the count on said counter means.

18. The apparatus of claim 15 including means for indicating the time of day, and means for recording the time of day when the means for detecting detects the occurrence of the event, with the means for reproducing also reproducing the recorded time of day relative to the event.

19. The apparatus of claim 15 including means for recording the length of time the event persists, with the means for reproducing also reproducing the recorded length of time relative to the event.

20. The apparatus of claim 15 including means for indicating the time of day, means for recording the time of day when the means for detecting detects the occurrence of the event, and means for recording the length of time the event persists, with the means for reproducing also reproducing the recorded time of day relative to the event, and the recorded length of time relative to the event.

21. The apparatus of claim 15 including means for storing a threshold time for the event to be detected, means for recording the length of time the event persists, means for comparing the recorded length of time with the threshold time, and means for discarding the information relative to the event which does not pass the threshold test associated with the threshold time.

22. The apparatus of claim 15 wherein the means for reproducing the information includes video monitoring means.

23. The apparatus of claim 15 wherein the means for reproducing the information includes printing means for printing a hard copy.

24. The apparatus of claim 15 wherein the means for storing information includes a keyboard and memory means, and the means for reproducing the information includes video monitoring means, with said memory means including instructions for display on said video monitoring means which directs the entry of requested information into said memory means via said keyboard.

25. The apparatus of claim 15 wherein the means for detecting the occurrence of the event includes first and second programmable processors and a common memory, with the first processor detecting and storing in said common memory changes in the states of connected input cables, and with the second processor monitoring the information in the common memory to detect the occurrence of the event, with said second processor including means for storing the fact that the event has occurred.

26. The apparatus of claim 25 wherein the means for reproducing the information is connectable to the second processor, with the means for reproducing including information storage means, means for transferring the information held by the second processor means to its information storage means, and means for displaying the information transferred to its information storage means.

27. The apparatus of claim 15 including means for storing a threshold time for the event to be detected, means for recording the length of time the event persists, means for comparing the recorded length of time with the threshold time, and means for discarding the information relative to an event which does not persist for the threshold time.

28. Apparatus for aiding in the servicing of an elevator system having a plurality of control elements operable between first and second states, comprising:

a plurality of individually identifiable input leads connectable to be responsive to the states of selectable control elements of the elevator system, means for storing information relative to which of the plurality of input leads are to be connected to be responsive to specified control elements, and for selecting at least one of the specified control elements, and its state, which is to signify the occurrence of an event by the occurrence of the specified state, means for detecting the occurrence of the event when the input leads are connected as specified in the stored information, means for storing the fact that the event had been detected, and the state of all of the inputs to the connected input leads at the time the event is detected, and means for reproducing the information stored relative to the detection of the event.

* * * * *